US011879311B2

(12) United States Patent
Parlar et al.

(10) Patent No.: US 11,879,311 B2
(45) Date of Patent: Jan. 23, 2024

(54) METHOD OF GRAVEL PACKING OPEN HOLES

(71) Applicant: Schlumberger Technology Corporation, Sugar Land, TX (US)

(72) Inventors: Mehmet Parlar, Sugar Land, TX (US); Balkrishna Gadiyar, Houston, TX (US); Julien Debard, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 427 days.

(21) Appl. No.: 17/291,709

(22) PCT Filed: Nov. 6, 2019

(86) PCT No.: PCT/US2019/060032
§ 371 (c)(1),
(2) Date: May 6, 2021

(87) PCT Pub. No.: WO2020/097180
PCT Pub. Date: May 14, 2020

(65) Prior Publication Data

US 2022/0003082 A1 Jan. 6, 2022

Related U.S. Application Data

(60) Provisional application No. 62/757,120, filed on Nov. 7, 2018.

(51) Int. Cl.

| | |
|---|---|
| ***E21B 43/04*** | (2006.01) |
| ***E21B 43/08*** | (2006.01) |
| ***E21B 43/10*** | (2006.01) |

(52) U.S. Cl.
CPC ..... *E21B 43/04* (2013.01); *E21B 43/08* (2013.01); *E21B 43/10* (2013.01)

(58) Field of Classification Search
CPC ..... E21B 43/04; E21B 43/08; E21B 43/10; E21B 43/045
See application file for complete search history.

(56) References Cited

U.S. PATENT DOCUMENTS

| | | | |
|---|---|---|---|
| 5,058,677 | A | 10/1991 | Forrest |
| 7,128,160 | B2 | 10/2006 | Anyan et al. |

(Continued)

FOREIGN PATENT DOCUMENTS

| | | | |
|---|---|---|---|
| EP | 2957715 | B1 | 10/2017 |
| WO | 2011129937 | A2 | 10/2011 |
| WO | 2013103785 | A2 | 7/2013 |

OTHER PUBLICATIONS

International Preliminary Report on Patentability issued in the PCT Application PCT/US2019/060032, dated May 20, 2021, 7 pages.

(Continued)

*Primary Examiner* — George S Gray
(74) *Attorney, Agent, or Firm* — Jeffrey D. Frantz

(57) ABSTRACT

A method of gravel packing an open hole penetrating a subterranean information includes installing at least one sand control screen disposed about a tubular member into the open hole, circulating a slurry including an expandable gravel and a carrier fluid, depositing the slurry in the wellbore annulus surrounding the at least one sand control screen in an alpha wave beginning at a heel of the wellbore annulus, detecting at least one of: arrival of the alpha wave at a toe of the wellbore annulus and start of a beta wave at the toe of the wellbore annulus, stopping circulation of the slurry, and triggering the expandable gravel to expand to (Continued)

pack the wellbore annulus surrounding the at least one sand control screen above the alpha wave.

12 Claims, 2 Drawing Sheets

(56) References Cited

U.S. PATENT DOCUMENTS

| | | | | |
|---|---|---|---|---|
| 7,316,272 | B2 | 1/2008 | Hurst et al. | |
| 9,932,801 | B2 | 4/2018 | Raffn | |
| 10,012,057 | B2 | 7/2018 | Panamarathupalayam et al. | |
| 10,082,007 | B2 | 9/2018 | Broussard et al. | |
| 2003/0111224 | A1* | 6/2003 | Hailey, Jr. | E21B 34/06 166/278 |
| 2007/0017673 | A1 | 1/2007 | Hurst et al. | |
| 2007/0044962 | A1* | 3/2007 | Tibbles | E21B 43/045 166/278 |
| 2007/0227731 | A1* | 10/2007 | Contant | E21B 47/13 166/278 |
| 2007/0246213 | A1* | 10/2007 | Hailey | E21B 43/04 166/278 |
| 2009/0151942 | A1* | 6/2009 | Bernardi, Jr. | E21B 43/08 166/227 |
| 2010/0263861 | A1* | 10/2010 | Dykstra | E21B 43/04 166/278 |
| 2011/0247812 | A1* | 10/2011 | Panga | E21B 43/04 166/278 |
| 2013/0048280 | A1 | 2/2013 | Techentien et al. | |
| 2014/0251609 | A1* | 9/2014 | Broussard | E21B 34/102 166/278 |
| 2015/0027701 | A1* | 1/2015 | Panamarathupalayam | E21B 43/08 166/278 |
| 2021/0381345 | A1* | 12/2021 | Warren | E21B 43/04 |

OTHER PUBLICATIONS

International Search Report and Written Opinion issued in the PCT Application PCT/US2019/060032, dated Apr. 9, 2020 (10 pages).

Office Action and Search Report issued in Russian Patent Application No. 2021116171 dated Dec. 16, 2021, 12 pages with English translation.

* cited by examiner

METHOD OF GRAVEL PACKING OPEN HOLES

CROSS-REFERENCE TO RELATED APPLICATIONS

The present document is based on and claims priority to U.S. Provisional Application Ser. No. 62/757,120, filed Nov. 7, 2018, which is incorporated herein by reference in its entirety.

BACKGROUND

Many wells in oil and gas fields in deep-water/subsea environments are being completed as open holes. Because of the extremely high cost of intervention and high production rates, these wells require a reliable completion technique that prevents sand production and maximizes productivity throughout the entire life of the well. One such technique is open hole gravel packing.

Gravel packing is a method commonly used to complete a well in which the producing formations are loosely or poorly consolidated. In such formations, small particles (e.g., formation sand or fines) may be produced along with the desired formation fluids, which may cause several problems such as clogging the production flow path, erosion of the wellbore, and damage to expensive completion equipment. Production of particles such as fines can be reduced substantially using a steel wellbore screen in conjunction with particulate material sized to prevent passage of formation sand through the screen. Such particulate material, referred to as "gravel," is pumped as a gravel slurry and deposited into an annular region between the wellbore and the screen. The gravel, if properly packed, forms a barrier to prevent the fines from entering the screen, but allows the formation fluid to pass freely therethrough and be produced.

Fracturing is another operation that may employ particulate material deposition to advantage. Oil production formations may be stimulated by creating fractures in the production zones to open pathways through which the production fluids can flow to the wellbore. Particulate material known as proppants may be deposited from a slurry into the open fractures to maintain them in their open position.

To be effective, the gravel pack must be complete and devoid of voids. Voids are created when the carrier fluid used to convey the gravel is lost or leaks off too quickly. The carrier fluid may be lost either by passing into the formation or by passing through the screens where it is collected by the end portion of a service tool used in gravel packing applications, commonly known as a wash pipe, and returned to surface. It is expected and necessary for dehydration to occur at some rate to allow the gravel to be deposited in a desired location. However, when the gravel slurry dehydrates too quickly, the gravel can settle out and form a "bridge," whereby it blocks the flow of slurry beyond that point, even though there may be void areas beneath or beyond it. This can defeat the purpose of the gravel pack since the absence of gravel in the voids allows sand or fines to be produced through those voids. Therefore, in open hole gravel packing applications, it is important to achieve a complete gravel pack that is devoid of voids.

SUMMARY

A method of installing a gravel pack in a wellbore annulus of an open hole penetrating a subterranean formation includes installing at least one sand control screen into the open hole, the at least one sand control screen being disposed above a tubular member, circulating a slurry comprising an expandable gravel and a carrier fluid, depositing the slurry in the wellbore annulus surrounding the at least one sand control screen in an alpha wave beginning at a heel of the wellbore annulus, detecting at least one of: arrival of the alpha wave at a toe of the wellbore annulus, and start of a beta wave at the toe of the wellbore annulus, stopping circulation of the slurry, and triggering the expandable gravel to expand to pack the wellbore annulus surrounding the at least one sand control screen above the alpha wave.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1A:
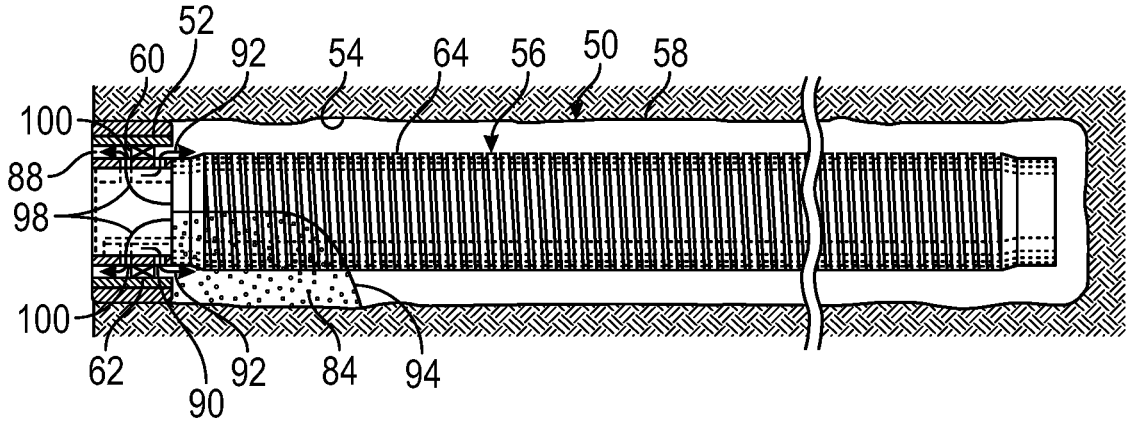
FIGS. 1A-1C show cross-sectional views of a completion interval depicting various stages of a gravel packing operation, according to one or more embodiments of the present disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims: the terms "up" and "down," "upper" and "lower," "upwardly" and "downwardly," "upstream" and "downstream," "uphole" and "downhole," "above" and "below," and other like terms indicating relative positions above or below a given point or element are used in this description to more clearly describe some embodiments of the disclosure.

The present disclosure generally relates to open hole gravel packing. In particular, embodiments disclosed herein relate to open hole gravel packing applications in which an expandable gravel is triggered to expand to completely pack the annular space above the alpha wave to achieve a complete gravel pack that is devoid of voids.

In the construction of a well, a casing may be positioned within a portion of a drilled wellbore and cemented into place. The portion of the wellbore that is not lined with the casing forms the uncased or open hole section where a sand control screen assembly is placed to facilitate gravel packing for controlling the migration and production of formation sand and to stabilize the formation of the open hole section.

Once the wellbore is drilled and the casing is cemented into place, the well may be completed by installing sand screens and gravel packing the open hole section so that produced fluids from the formation are allowed to flow through the gravel pack and sand screen and may be recovered through the wellbore. The open hole section may be any orientation, including vertical and horizontal hole sections.

In a gravel packing installation, a sand control screen assembly may be run or lowered to a selected depth within the open hole section of the wellbore. The sand screen assembly may be run or lowered into the wellbore on a tubular member or wash pipe, which is used for conducting fluids between the sand screen and the surface. Running the sand screen assembly to the selected depth may include positioning the sand screen in vertical or non-vertical (horizontal) sections of the well. A packer may be positioned and set in the casing above the sand screen to isolate the interval being packed. A crossover service tool may also be provided with the assembly to selectively allow fluids to flow between the annulus formed by the open hole and the screen assembly and the interior of the tubular member or wash pipe.

With the sand control screen assembly in place, a gravel pack slurry containing gravel for forming the gravel pack and a carrier fluid is introduced into the wellbore to facilitate gravel packing of the open hole section of the wellbore in the annulus surrounding the sand control screen. The gravel pack slurry may be introduced into the tubular member where it flows to the crossover service tool into the annulus of the open hole section below the packer and the exterior of the sand control screen. As the gravel settles within the open hole section surrounding the screen, the carrier fluid passes through the screen and into the interior of the tubular member. The carrier fluid is conducted to the crossover tool and into the annulus between the casing and the tubular member above the packer.

There are two principal techniques used for gravel packing open hole horizontal wells: (1) the water packing (or "alpha-beta" packing) technique; and (2) the alternate path packing technique. The water packing technique uses low-viscosity carrier fluids, such as completion brines, to carry the gravel from the surface and deposit it into the annulus between a sand-control screen and the wellbore. The alternate path technique, on the other hand, utilizes viscous carrier fluids. Therefore, the packing mechanisms of these two techniques are significantly different when the viscosity and/or elasticity of the carrier fluid is such that gravel settling is minimized. The alternate path technique allows bypassing of any bridges that may form in the annulus, caused for example by exceeding the fracturing pressure, or shale-sloughing/shale-swelling or localized formation collapse on the sand control screens.

Operators are increasingly moving towards drilling and completing longer and longer wells to access reserves in various zones through a single wellbore to increase efficiency and reduce costs. Achieving targeted production rates in such wells requires high inclination open hole completions and often further necessitates the use of zonal isolation through open hole packers and inflow control devices (ICDs). Gravel packing of these wells introduces significant challenges, which are yet to be fully addressed. Because ICDs introduce a significant pressure drop for the carrier fluid to enter the wash-pipe/screen annulus at the rates a gravel packing treatment is performed, the pressure that the formation will experience would exceed the fracturing pressure resulting in an immediate termination of the treatment. To address this concern, a common practice in the water packing technique is to include a few joints of non-ICD (conventional) screens and perform an alpha/alpha gravel pack treatment by reducing the pump rate during the treatment, which often results in a single alpha-wave and almost always results in an incomplete gravel pack.

Fracturing the formation is similarly a major concern in long open hole completions with a low fracturing window, particularly with low viscosity fluids even when no ICDs are used in the entire screen assembly. In such cases, the bottom part of the high inclination/horizontal well is gravel packed through settling of gravel with the height of this pack (called the "alpha wave," which proceeds from heel to toe) reaching an equilibrium based on geometric factors and the pump rate until the alpha wave reaches the toe of the well, and remaining annular space above the dune formed during the alpha wave is then packed in a toe to heel fashion (called the "beta wave"). During the beta wave, the carrier fluid deposits the gravel outside the screen, and the excess carrier fluid enters into an annulus between the screen and the wash pipe (a pipe inside the screen). Because the friction pressure in the screen/wash pipe annulus is higher than the other areas in the completion, pressure that the formation experiences starts increasing, which can at some point exceed the fracturing pressure of the formation, resulting in an incomplete gravel pack.

With viscous fluids that do not suspend the gravel perfectly, there is still gravel settling (and thus an alpha wave) in high inclination wells, with an equilibrium alpha wave height that is smaller than low viscosity fluids such as a brine. Depending on the nature of the viscous fluid, various mechanisms can cause loss of gravel suspension capability of the fluid. For example, many viscoelastic surfactant fluids can lose their viscosity and/or elasticity when they are exposed to certain contaminants which include any undisplaced oil-based fluids, mutual solvents, etc. High shear rates in the pumping path can degrade the viscosifier causing temporary or permanent loss of gravel suspension properties of the carrier fluid. Thus, one or more embodiments of the present disclosure may also be applicable to cases where such problems may be encountered with viscous fluids.

Figure 1B:
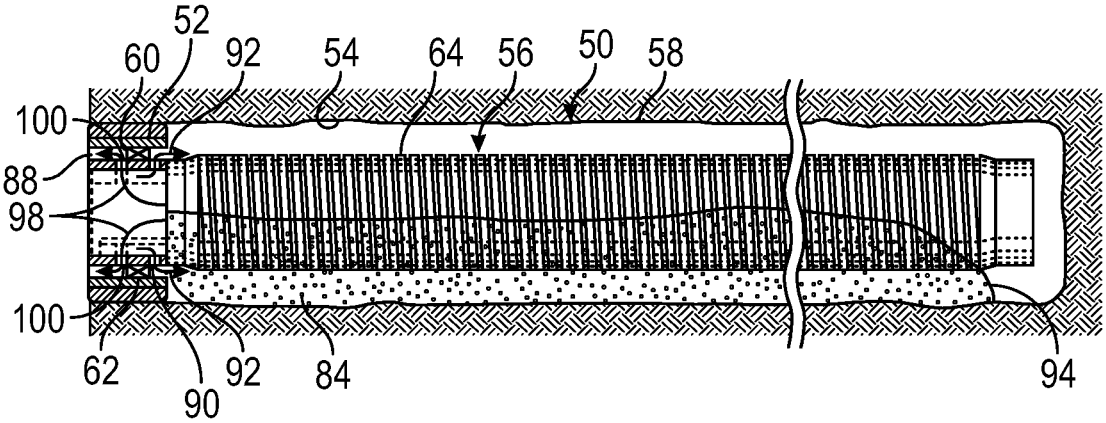

Referring to FIGS. 1A-1B, a schematic of a horizontal open hole completion interval of a well that is generally designated 50 being filled by alpha-beta packing is shown. As shown in FIG. 1A, casing 52 is cemented within a portion of a well 54 proximate the heel or near end of the horizontal portion of well 54. A work string 56 extends through casing 52 and into the open hole completion interval 58. A packer assembly 60 is positioned between work string 56 and casing 52 at a cross-over assembly 62. Work string 56 includes one or more sand control screen assemblies such as sand control screen assembly 64. Sand control screen assembly 64 includes a sand control screen having a plurality of openings that allow the flow of fluids therethrough. The sand control screen may be disposed about a tubular member, which may be a wash pipe of a wash pipe assembly according to one or more embodiments.

Still referring to FIGS. 1A-1B, in a gravel packing operation, fluid slurry 84 is delivered down work string 56 into cross-over assembly 62. Fluid slurry 84 exits cross-over assembly 62 through cross-over ports 90 and is discharged into open hole completion interval 58 as indicated by arrows 92. In the illustrated embodiment of alpha-beta packing, fluid slurry 84 then travels within open hole completion interval 58 with portions of the gravel dropping out of the slurry and building up on the low side of wellbore 54 from the heel to the toe of wellbore 54 as indicated by alpha wave front 94 of the alpha wave portion of the gravel pack. At the same time, portions of the carrier fluid pass through sand control screen assembly 64 and travel through an annulus between the wash pipe assembly and an interior of sand control screen assembly 64. These return fluids enter the far end of the wash pipe assembly, flow back through the wash pipe assembly to cross-over assembly 62, as indicated by arrows 98, and flow into annulus 88 through cross-over ports 100 for return to the surface.

As shown through the progression of FIGS. 1A-1B, the alpha-beta packing operation starts with the alpha wave depositing gravel in an annulus on the low side of the wellbore 54 progressing from the near end (heel) to the far end (toe) of the wellbore annulus. Gravitational forces dominate this "alpha" wave, so gravel settles until reaching an equilibrium height. If fluid flow remains above the crucial velocity for particle transport, gravel will move down a horizontal section from the heel toward the toe of the wellbore annulus.

Figure 1C:
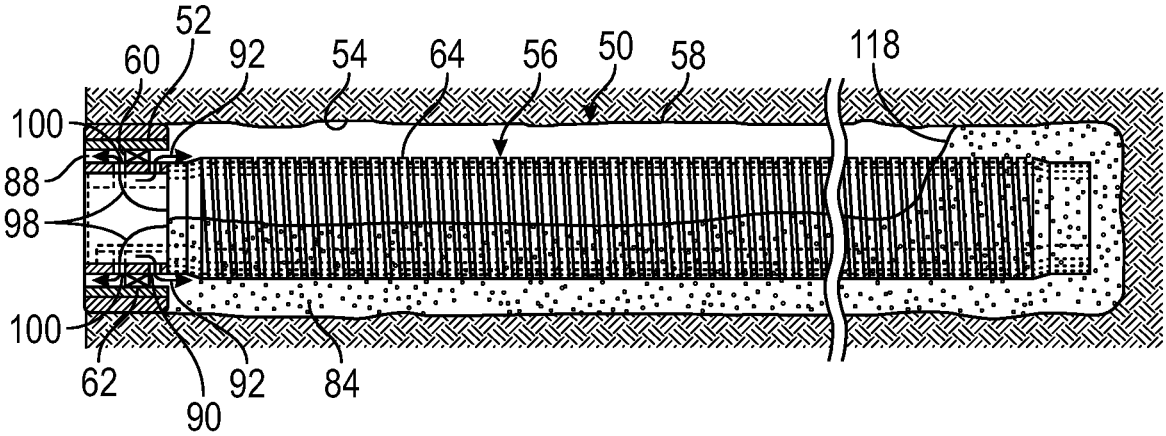

Particularly, FIG. 1B shows the alpha wave beginning to arrive at the toe of the wellbore annulus in accordance with one or more embodiments of the present disclosure. According to the alpha-beta packing technique, once the alpha wave has reached the toe of the wellbore annulus, a second "beta" wave phase, as indicated by beta wave front 118 (FIG. 1C), begins to deposit gravel on top of the alpha wave deposition, progressing from the far (toe) end to the near (heel) end of the wellbore annulus. According to one or more embodiments of the present disclosure, and as further described below, upon detection of at least one of the arrival of the alpha wave at the toe of the wellbore annulus, and the start of the beta wave at the toe of the wellbore annulus, circulation of the fluid slurry 84 is stopped, which stops the deposition of the gravel in the wellbore annulus. In accordance with one or more embodiments, the arrival of the alpha wave at the toe of the wellbore annulus, and the start of the beta wave at the toe of the wellbore annulus, may occur at a stage that is between the snapshots of the alpha-beta packing operation shown in FIGS. 1B and 1C.

According to one or more embodiments of the present disclosure, the fluid slurry 84 may include an expandable gravel and a carrier fluid. In a pre-expanded state, the gravel is sized so as to not pass through openings of the sand control screen during the gravel packing operation. In one or more embodiments, the expandable gravel includes at least one reactive component that is triggered by at least one of the salinity, temperature, pH, or other property of the wellbore or surrounding environment to cause the expandable gravel to expand and increase in volume. After alpha wave deposition of the expandable gravel in the wellbore annulus has stopped, as previously described, the expandable gravel is triggered to expand to pack the wellbore annulus surrounding the sand control screen above the alpha wave deposition in accordance with one or more embodiments of the present disclosure. Advantageously, the expandable gravel is able to expand to completely pack the wellbore annulus to achieve a complete gravel pack for effective sand control during production. Moreover, expansion of the gravel does not put undue pressure on the formation. That is, when the gravel expands, the pressure on the formation may be only 2000 psi or less, as opposed to 7000-10,000 psi (i.e., possible pressure on the formation resulting from a traditional beta wave deposited on top of the alpha wave deposition), which could cause the screens to collapse. Stated another way, according to one or more embodiments of the present disclosure, the pressure exerted on the subterranean formation and the sand control screen after expansion of the expandable gravel is less than a collapse pressure rating of the sand control screen.

As previously described, the sand control screen may be disposed about a tubular member, which may be a wash pipe according to one or more embodiments. Further, a detection mechanism may be installed at a toe of the tubular member or wash pipe according to one or more embodiments. By being installed at the toe of the tubular member or wash pipe, the detection mechanism is able to detect at least one of the arrival of the alpha wave at the toe of the wellbore annulus, and the start of the beta wave at the toe of the wellbore annulus. According to one or more embodiments of the present disclosure, the detection mechanism installed at the toe of the tubular member or wash pipe may be a sensor that identifies a component of the expandable gravel, at least one real-time downhole gauge that may measure a pressure increase that is indicative of the end of the alpha wave and the beginning of the beta wave, a densimeter that measures the density of the gravel near the toe of the wellbore annulus, another type of sensor, or a rupture disk.

In other embodiments of the present disclosure, a detection mechanism that measures pressure at the surface of the wellbore is able to detect at least one of the arrival of the alpha wave at the toe of the wellbore annulus, and the start of the beta wave at the toe of the wellbore annulus. For example, a pressure change may be sensed at the surface by a suitable device disposed on a pressure line extending from the toe of the wellbore annulus to the surface. Moreover, other types of surface sensors are contemplated and are within the scope of the present disclosure. For example, one or more surface pressure sensors may be implemented to detect pressure changes that result during the progression of the alpha wave from the heel to the toe of the wellbore annulus, or to detect a significant (friction) pressure increase that occurs as the gravel packing operation transitions from the end of the alpha wave to the start of the beta wave.

According to one or more embodiments of the present disclosure, the sand control screen of the sand control screen assembly 64 may include at least one inflow control device (ICD) or other type of flow restriction device. In one or more embodiments, the ICD restricts flow from the exterior of the sand control screen assembly 64 into the interior of the sand control screen assembly 64. For example, the ICD may be used during production operations to enable the inflow of production fluids to an interior of a base pipe of the sand control screen assembly 64. According to one or more embodiments of the present disclosure, the ICD may also be used during gravel packing operations to receive a portion of the returning carrier fluid from the fluid slurry.

As previously described, work string 56 may include more than one sand control screen assembly 64, each having a sand control screen. According to one or more embodiments of the present disclosure, the gravel packing operation may implement multiple sand control screens including at least one sacrificial screen and at least one non-sacrificial screen. According to one or more embodiments, the non-sacrificial screen may include an ICD, and the sacrificial screen may be configured without an ICD, for example.

Another problem common to gravel packing horizontal wells is the sudden rise in pressure within the wellbore when the alpha wave reaches the toe of the wellbore annulus. Conventionally, the return or beta wave carries gravel back up the wellbore, filling the upper portion left unfilled by the alpha wave. As the beta wave progresses up the wellbore, the pressure in the wellbore increases because of frictional resistance to the flow of the carrier fluid. The carrier fluid not lost to the formation conventionally must flow to the toe region because the wash pipe terminates in that region. When the slurry reaches the upper end of the beta wave, the carrier fluid must travel the distance to the toe region in a small annular space between the screen and the wash pipe.

As this distance increases, the friction pressure increases, causing the wellbore pressure to increase. Moreover, the friction pressure increase may be controlled by a smaller screen internal diameter, a larger wash pipe outside diameter, the length of the screen joints near the toe of the wellbore annulus, or any combination of these, for example. However, because one or more embodiments of the present disclosure triggers the expandable gravel deposited during the alpha wave to expand to completely pack the wellbore annulus instead of depositing gravel in a conventional beta wave on top of the alpha wave, a pressure rise during the "beta wave" phase of the alpha-beta packing operation does not exceed a friction pressure across at least one sacrificial screen of a sand control screen assembly 64 or at least one joint of at least one non-sacrificial screen of the sand control screen assembly 64.

According to one or more embodiments of the present disclosure, the gravel packing operation may implement at least one sand control screen that is an alternate path screen with shunt tubes. In such embodiments, the fluid slurry 84 would be diverted to flow through shunt tubes on the outside of the sand control screen assembly 64, which provide an alternative pathway for the fluid slurry 84. In such embodiments, the shunt tubes may act as a conduit for the fluid slurry 84 to flow across a packer or collapsed shale section. As such, bridges that may form in the wellbore annulus during gravel packing may be bypassed, facilitating the formation of a more complete gravel pack. More specifically, the alternate path screen with shunt tubes is disposed only in completion sections that are isolated with at least one of a packer and a shale section according to one or more embodiments of the present disclosure. In this way, any bridges caused by exceeding the fracturing pressure, or shale-sloughing/shale-swelling or localized formation collapse on the sand control screens, for example, may be bypassed by the shunt tubes.

Figure 2:
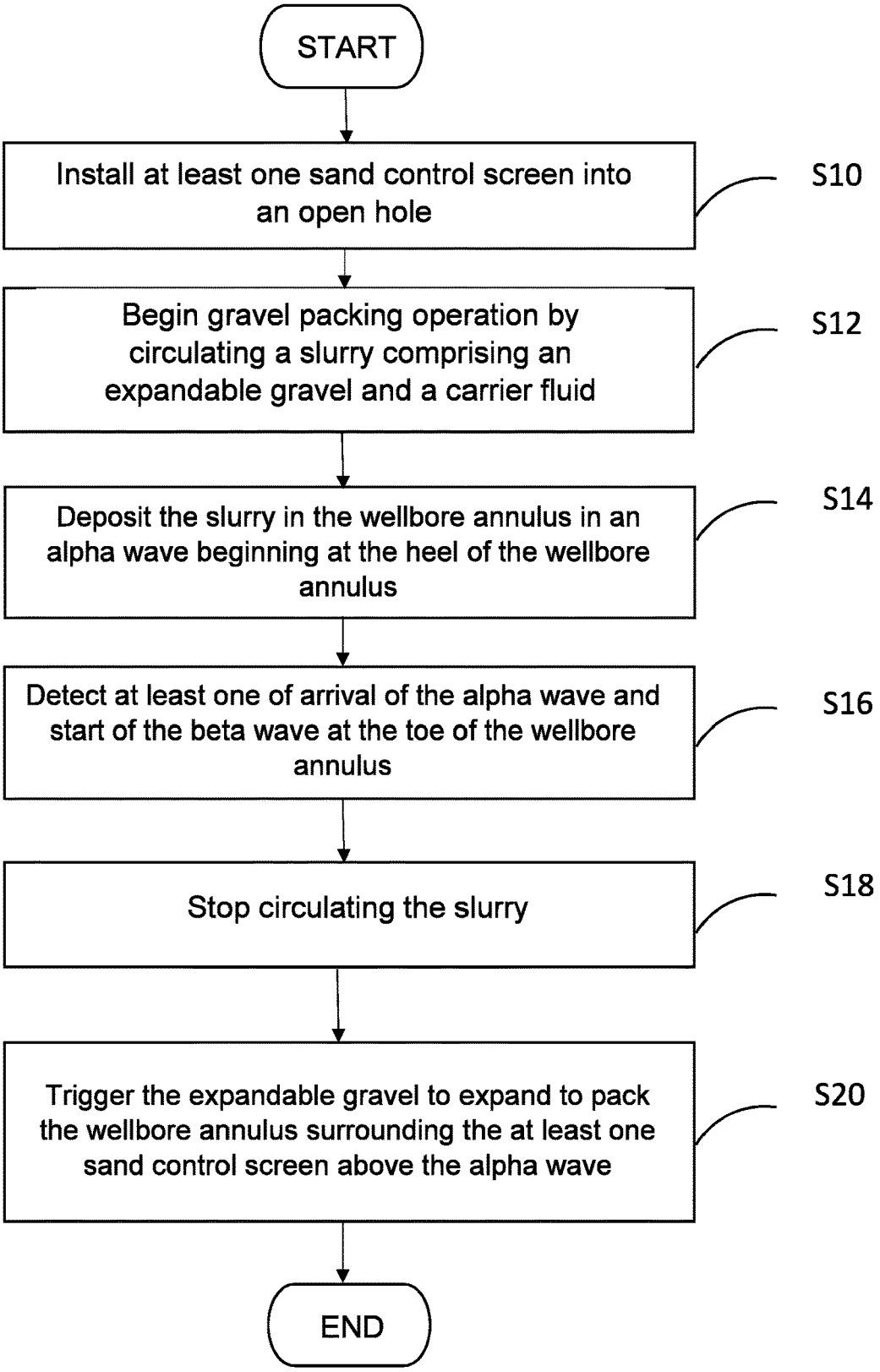
FIG. 2 shows a flowchart of a method of installing a gravel pack in a wellbore annulus of an open hole penetrating a subterranean formation according to one or more embodiments of the present disclosure.

Referring now to FIG. 2, a flowchart of a method of installing a gravel pack in a wellbore annulus of an open hole penetrating a subterranean formation according to one or more embodiments of the present disclosure is shown. In one or more embodiments, the method begins at step S10, where at least one sand control screen is installed into an open hole. For installation, the at least one sand control screen may be run or lowered to a selected depth within the open hole section of the wellbore on a tubular member or wash pipe, for example. In one or more embodiments, a packer may be positioned and set above the at least one sand control screen to isolate the interval to be packed, and a crossover service tool may be provided to selectively allow fluids to flow between the annulus formed by the open hole and the at least one sand control screen and the interior of the tubular member or wash pipe.

In step S12 of FIG. 2, the gravel packing operation begins by circulating a slurry that includes an expandable gravel and a carrier fluid. In one or more embodiments, the fluid slurry may be introduced into the tubular member where it flows to the crossover service tool into the annulus of the open hole section below the packer and the exterior of the at least one sand control screen.

In step S14 of FIG. 2, the fluid slurry is deposited in the wellbore annulus in an alpha wave beginning at the heel of the wellbore annulus. According to one or more embodiments of the present disclosure, the alpha wave deposits the expandable gravel of the slurry in an annulus on the low side of the wellbore progressing from the near end (heel) to the far end (toe) of the wellbore annulus. In one or more embodiments, as the expandable gravel settles within the open hole section surrounding the at least one sand control screen, the carrier fluid passes through the screen and into the interior of the tubular member. The carrier fluid is conducted to the crossover tool and into the annulus between the casing and the tubular member above the packer.

In step S16 of FIG. 2, at least one of the arrival of the alpha wave and the start of the beta wave at the toe of the wellbore annulus is detected. According to one or more embodiments of the present disclosure, a detection mechanism may be installed at a toe of the tubular member or wash pipe for detection of at least one of the arrival of the alpha wave and the start of the beta wave at the toe of the wellbore annulus. In one or more embodiments, the detection mechanism installed at the toe of the tubular member or wash pipe may be a sensor that identifies a component of the expandable gravel, at least one real-time downhole gauge that may measure a pressure increase that is indicative of the end of the alpha wave and the beginning of the beta wave, a densimeter that measures the density of the gravel near the toe of the wellbore annulus, another type of sensor, or a rupture disk. In other embodiments of the present disclosure, a detection mechanism that measures pressure at the surface of the wellbore may be able to detect at least one of the arrival of the alpha wave at the toe of the wellbore annulus, and the start of the beta wave at the toe of the wellbore annulus.

The method according to one or more embodiments of the present disclosure may also include using numerical simulations to predict the arrival of the alpha wave at the toe of the wellbore annulus, or the start of the beta wave at the toe of the wellbore annulus.

In step S18 of FIG. 2, circulation of the fluid slurry is stopped after detection of at least one of the arrival of the alpha wave and the start of the beta wave at the toe of the wellbore annulus.

In step S20 of FIG. 2, the expandable gravel is triggered to expand to pack the wellbore annulus surrounding the at least one sand control screen above the alpha wave. In one or more embodiments, the expandable gravel includes at least one reactive component that is triggered by at least one of the salinity, temperature, pH, or other property of the wellbore environment to cause the expandable gravel to expand and increase in volume. Advantageously, the expandable gravel is able to expand to completely pack the wellbore annulus to achieve a complete gravel pack that is devoid of voids for effective sand control during production, without putting undue pressure on the formation.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A method of installing a gravel pack in a wellbore annulus of an open hole penetrating a subterranean formation comprising:

installing at least one sand control screen into the open hole, the at least one sand control screen being disposed about a tubular member;

circulating a slurry comprising an expandable gravel and a carrier fluid;

depositing the slurry in the wellbore annulus surrounding the at least one sand control screen in an alpha wave beginning at a heel of the wellbore annulus;

detecting at least one of:

an arrival of the alpha wave at a toe of the wellbore annulus; or a start of a beta wave at the toe of the wellbore annulus;

stopping circulation of the slurry upon the detecting of at least one of the arrival of the alpha wave or the start of the beta wave; and upon the stopping of circulation of the slurry, triggering the expandable gravel to expand to pack the wellbore annulus surrounding the at least one sand control screen above the alpha wave.

2. The method of claim 1, wherein the detecting step comprises using a detection mechanism installed at a toe of the tubular member.

3. The method of claim 2, wherein the tubular member is a wash pipe.

4. The method of claim 3, wherein the detection mechanism is a sensor that identifies a component of the expandable gravel.

5. The method of claim 3, wherein the detection mechanism comprises at least one real-time downhole gauge.

6. The method of claim 1, wherein the detecting step comprises using a detection mechanism that measures pressure at a surface.

7. The method of claim 1, wherein the at least one sand control screen comprises at least one inflow control device.

8. The method of claim 1, wherein the at least one sand control screen comprises at least one sacrificial screen and at least one non-sacrificial screen.

9. The method of claim 1, wherein the triggering step comprises using at least one triggering mechanism selected from the group consisting of: salinity; temperature; and pH to expand the expandable gravel.

10. The method of claim 1, wherein the at least one sand control screen is an alternate path screen with shunt tubes.

11. The method of claim 1, wherein pressure exerted on the subterranean formation and the at least one sand control screen after expansion of the expandable gravel is less than a collapse pressure rating of the at least one sand control screen.

12. The method of claim 1, wherein the expandable gravel is triggered to expand to completely pack the wellbore annulus surrounding the at least one sand control screen above the alpha wave, such that the wellbore annulus is devoid of voids.

* * * * *